US007290424B2

(12) United States Patent
Fullerton et al.

(10) Patent No.: US 7,290,424 B2
(45) Date of Patent: Nov. 6, 2007

(54) PUSH BENCH METHOD FOR MANUFACTURING SMALL DIAMETER TUBING

(75) Inventors: Paul Fullerton, Plano, TX (US); Nathan A. Roden, Lindale, TX (US); David R. Witt, Longview, TX (US)

(73) Assignee: Lone Star Steel Company, L.P., Dallas, TX (US)

( * ) Notice: Subject to any disclaimer, the term of this patent is extended or adjusted under 35 U.S.C. 154(b) by 113 days.

(21) Appl. No.: 11/038,807

(22) Filed: Jan. 19, 2005

(65) Prior Publication Data

US 2006/0053859 A1 Mar. 16, 2006

Related U.S. Application Data

(60) Provisional application No. 60/610,308, filed on Sep. 16, 2004.

(51) Int. Cl.
*B21C 1/26* (2006.01)

(52) U.S. Cl. ..... 72/284

(58) Field of Classification Search ..... 72/284, 72/290, 291, 287
See application file for complete search history.

(56) References Cited

U.S. PATENT DOCUMENTS

| | | | | |
|---|---|---|---|---|
| 1,913,206 | A | 6/1933 | Littler | |
| 1,951,073 | A * | 3/1934 | Wallis | 72/290 |
| 3,036,696 | A * | 5/1962 | Zimpel | 72/348 |
| 3,266,283 | A * | 8/1966 | Miller | 72/284 |
| 3,293,894 | A * | 12/1966 | Edgecombe et al. | 72/42 |
| 3,453,854 | A * | 7/1969 | Lombardo et al. | 72/284 |
| 3,552,174 | A * | 1/1971 | McGoogan | 72/284 |
| 4,079,616 | A * | 3/1978 | Zazimko et al. | 72/278 |
| 4,224,818 | A | 9/1980 | Jones et al. | 72/284 |
| 4,260,096 | A | 4/1981 | Samarynov et al. | 228/158 |
| 4,275,578 | A | 6/1981 | Steinbrecher et al. | 72/14 |
| 4,277,967 | A | 7/1981 | Staat et al. | 72/224 |
| 4,313,325 | A | 2/1982 | Staat et al. | 72/208 |
| 4,565,664 | A | 1/1986 | Ikehata et al. | 264/130 |
| 4,928,507 | A | 5/1990 | Staat et al. | 72/38 |
| 6,634,201 | B2 * | 10/2003 | Hosonuma | 72/277 |
| 6,807,837 | B1 * | 10/2004 | Alexoff | 72/276 |

FOREIGN PATENT DOCUMENTS

| | | |
|---|---|---|
| JP | 63-242417 | * 10/1988 |
| JP | S63-242417 | 10/1988 |

* cited by examiner

*Primary Examiner*—Daniel C Crane
(74) *Attorney, Agent, or Firm*—Baker Botts L.L.P.

(57) ABSTRACT

The present invention involves cost effective, efficient systems and methods for sizing pipe. In an embodiment of the present invention, a pipe sizing system includes a die having an opening operable to size the pipe, a hydraulic cylinder having at least one rod attached thereto, the hydraulic cylinder and the at least one rod cooperating with each other to push the pipe through the die, and a receiver to guide the pipe as the pipe exits from the die.

14 Claims, 7 Drawing Sheets

PUSH BENCH METHOD FOR MANUFACTURING SMALL DIAMETER TUBING

RELATED APPLICATIONS

This application claims the benefit, under 35 U.S.C. § 119(e), of previously filed provisional application Push Bench and Method of Manufacturing Small Diameter Tubing, Ser. No. 60/610,308, filed Sep. 16, 2004.

TECHNICAL FIELD

The present invention is related in general to cost effective, efficient systems and methods to size and shape pipe, particularly for applications with critical dimensional tolerances and/or irregular configurations.

BACKGROUND OF THE INVENTION

Conventional continuous tube rolling mills are extremely complex installations requiring large capital investments that can only be paid back if high capacities are well utilized. There is a rising demand world-wide, however, for smaller capacity plants with a correspondingly lower investment burden. This is particularly true in the specialty pipe business, where manufacturing specialty pipe from long hollow tubes may be cost prohibitive.

Specialty pipe (or tubing) refers to a wide variety of high-quality, custom-made tubular products requiring critical tolerances, precise dimensional control and special metallurgical properties. Specialty pipe is typically used in the manufacture of automotive, construction and agricultural equipment, oil country tubular good (OCTG) applications, petrochemical applications, and industrial applications such as hydraulic cylinders, machine parts and printing rollers. OCTG is a label typically applied to the pipe products used by petroleum exploration and production customers, such as tubing, casing, pup joints, risers and couplings.

In order to produce specialty pipe that meets more stringent standards, pipe produced from traditional methods, such as electric resistant welding (ERW) technology, is then worked to form specialty pipe with more exacting qualities. Often, specialty pipe needs to be sized in order to meet customer standards. Typical methods to decrease an outer diameter of a pipe involve using rollers or drawing through a die. Using rollers typically is disadvantageous because roller systems often cannot produce pipe with tight tolerances. Many specialty pipes, such as stabilizer bars in the automotive industry, require precise tolerances of $^{9}/_{1000}$'s of an inch.

Other methods of sizing pipe, such as drawing through a die, may produce pipes with tight tolerances. However, drawing systems have disadvantages as well. Drawing a pipe through a die typically requires auxiliary pre-treatment and post-treatment operations. For example, required pre-treatment operations include pickling and lubricating the pipe as well as swaging one end of the pipe (thereby creating about a 12% material loss). Drawn pipes also typically require post-treatment operations to straighten and stress relieve the tube. Stress relieving is often necessary because typical drawing systems use mandrels that cause the pipe to lose a significant portion of the pipe's fracture toughness when drawn through an associated die.

SUMMARY OF THE INVENTION

In accordance with teachings of the present invention, a system and method are described for sizing pipe that substantially reduce disadvantages and problems associated with previous systems and methods of sizing pipe. In one embodiment, a pipe sizing system includes a die having an opening operable to size the pipe, a hydraulic cylinder having at least one rod attached thereto, the hydraulic cylinder and the at least one rod cooperating with each other to push the pipe through the die, and a receiver to guide the pipe as the pipe exits from the die.

In another aspect of the invention, a push bench system for sizing a pipe includes a die having an opening operable to size the pipe, a hydraulic cylinder having at least one rod attached thereto, the hydraulic cylinder and the at least one rod cooperating with each other to push the pipe through the die to form a sized pipe, a receiver to guide the sized pipe as the sized pipe exits from the die. The receiver is operable to manipulate the sized pipe to form a specific shape or configuration.

In one embodiment of the present invention, a push bench system for sizing at least two pipes includes at least two dies having openings operable to size the at least two pipes, a hydraulic cylinder having at least two rods attached thereto, the hydraulic cylinder and the at least two rods cooperating with each other to push the at least two pipes through the at least two dies, and at least two receivers to guide the at least two pipes as the at least two pipes exit from the at least two dies. In a particular embodiment, the at least two dies comprise three dies, the at least two rods comprise three rods, and the at least two receivers comprise three receivers.

In another embodiment of the present invention, a method of reducing an outside diameter of a pipe includes positioning the pipe to pass through a die having a longitudinal axis, pushing the pipe through the die using at least one hydraulic cylinder, and controlling movement of the pipe vertically (x direction) and laterally (y direction) relative to the longitudinal axis as the pipe exits from the die. In one embodiment, the method further includes simultaneously pushing a second pipe and a third pipe through a second die and a third die using the at least one hydraulic cylinder. In another embodiment, the method further includes pushing the pipe through a die without the use of a mandrel.

In one embodiment of the present invention, a method of reducing an outside diameter of a pipe includes positioning the pipe to pass through a die having a longitudinal axis, pushing the pipe through the die using at least one hydraulic cylinder, controlling movement of the pipe vertically (x direction) and laterally (y direction) relative to the longitudinal axis as the pipe exits from the die, and performing at least one post-die operation as the pipe exits from the die. In certain exemplary embodiments, the at least one post-die operation includes treating the pipe. In other exemplary embodiments, the at least one post-die operation includes inspecting the pipe.

In another embodiment of the present invention, a method for forming a push bench operable to size a pipe includes installing a die having a longitudinal axis and an opening operable to size the pipe, installing a hydraulic cylinder having at least one rod attached thereto along the longitudinal axis, and installing a receiver along the longitudinal axis.

Teachings of the present invention may be used to size portions of pipe used in automotive, construction and agricultural equipment as well as OCTG, petrochemical, and other industrial applications.

BRIEF DESCRIPTION OF THE DRAWINGS

A more complete and thorough understanding of the present embodiments and advantages thereof may be acquired by referring to the following description taken in conjunction with the accompanying drawings, in which like reference numbers indicate like features, and wherein.

DETAILED DESCRIPTION OF THE INVENTION

Preferred embodiments of the invention and its advantages are best understood by reference to FIGS. 1-17 wherein like numbers refer to same and like parts.

Figure 1:
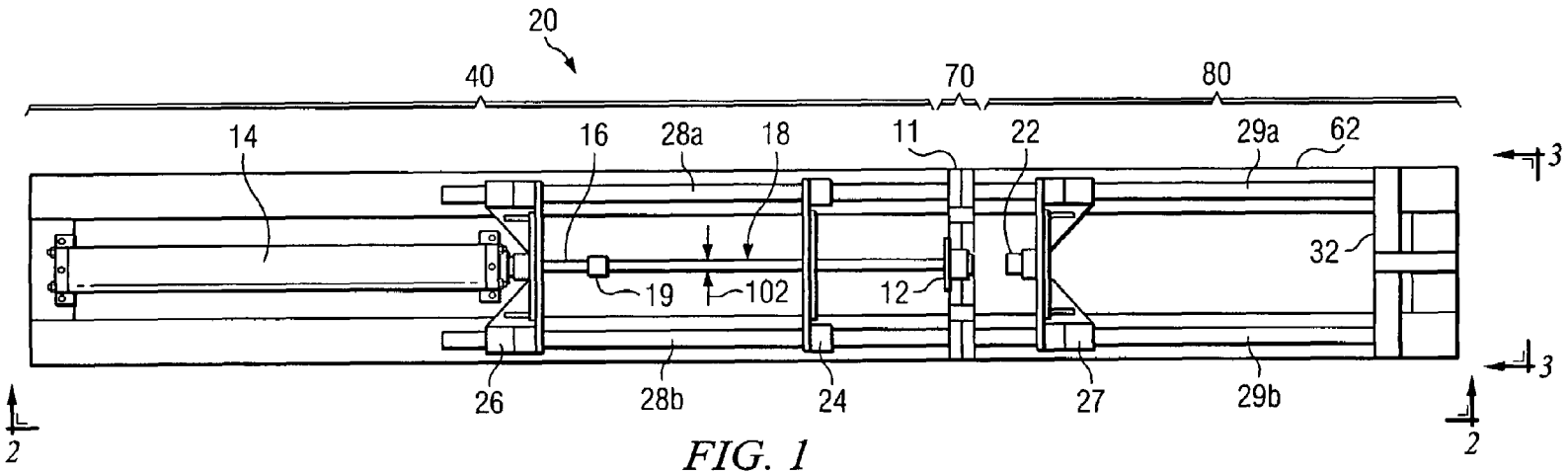
FIG. 1 is a schematic drawing showing a plan view of one example of a pipe sizing system incorporating teachings of the present invention.
Figure 2:
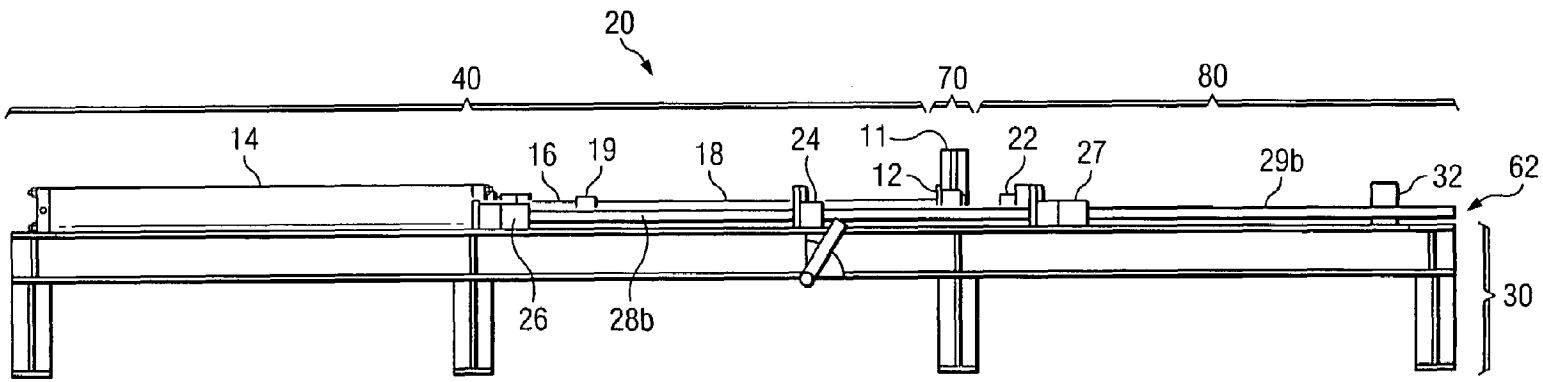
FIG. 2 is a schematic drawing taken along lines 2-2 of FIG. 1.

FIG. 1 shows one example of a pipe sizing system incorporating teaching of the present invention before pipe 18 has been sized. Pipe sizing system 20 may include push bench section 40, die assembly 70 and receiver section 80. FIG. 2 shows a side view of pipe sizing system 20 taken along lines 2-2 of FIG. 1 showing push bench section 40, die assembly 70 and receiver section 80 resting on foundation 30. Foundation 30 may serve as a base for pipe sizing system 20.

As shown in FIG. 1, push bench section 40 may include hydraulic cylinder 14, rod 16, rod guide 26, rails 28*a* and 28*b*, coupling 19 and support 24. Push bench section 40 generally includes hydraulic cylinder 14. Hydraulic cylinder 14 provides the energy to push pipe 18 through die assembly 70. In certain exemplary embodiments, hydraulic cylinder 14 provides a controlled push speed. In other embodiments, hydraulic cylinder 14 may provide a variable push speed. Having a controlled push speed may allow for greater control of sizing, treating and inspecting pipe 18 when compared with other sizing systems such as rollers.

Figure 6:
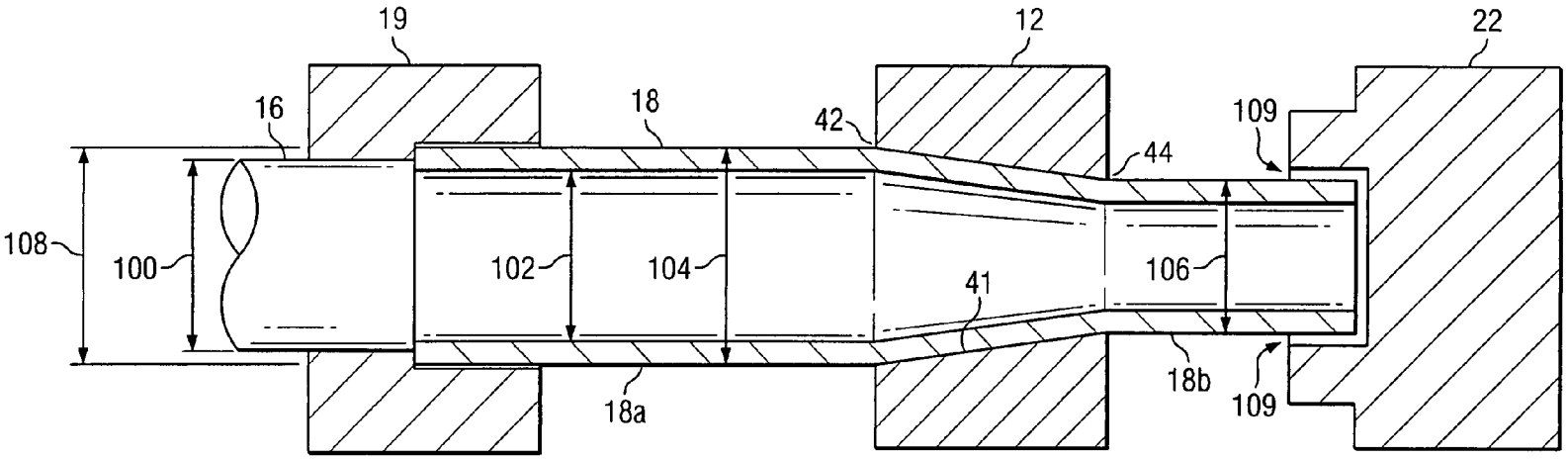
FIG. 6 is a schematic drawing showing a pipe being sized according to teachings of the present invention.
Figure 7:
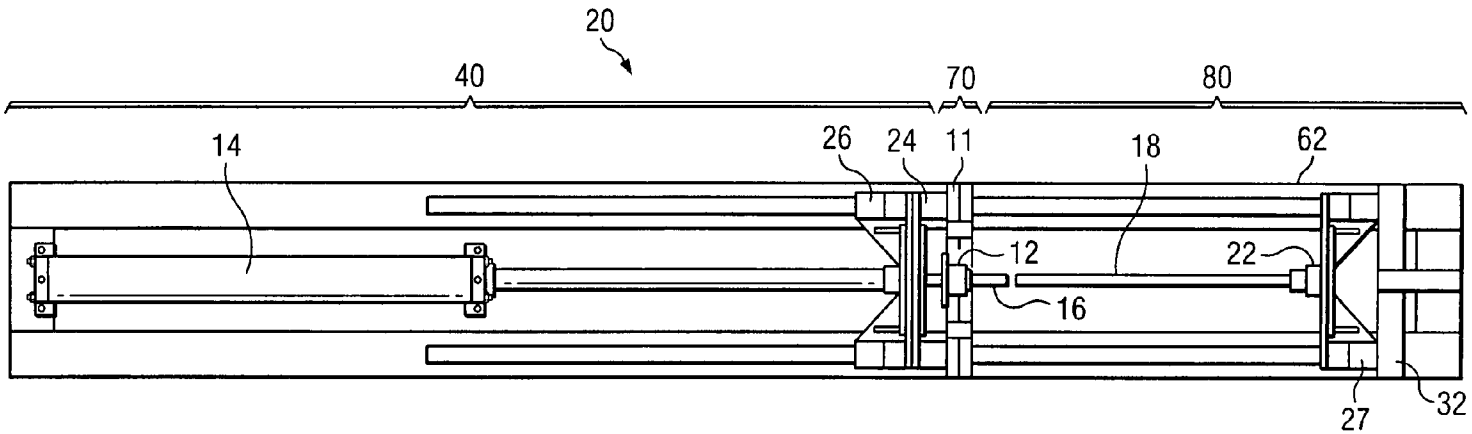
FIG. 7 is a schematic drawing showing a plan view of a pipe sizing system after sizing a pipe according to teachings of the present invention.

Hydraulic cylinder 14 may be attached to rod 16. Rod 16 releasably engages pipe 18 and serves to move pipe 18 into die assembly 70. In order to push pipe 18 through die 12, rod 16 preferably includes coupling 19 with inside diameter 108 that is greater than outside diameter 104 of pipe 18. (See FIG. 6). Rod 16 also preferably has outside diameter 100 that is smaller than the exiting diameter 44 of die 12 so that portions of rod 16 may pass through die 12. (See FIGS. 4 and 6). FIG. 7 shows an embodiment where hydraulic cylinder 14 has pushed pipe 18 and a portion of rod 16 through die 12. In other embodiments, rod 16 may be associated with rod guide 26 (here shown on rails 28*a* and 28*b*) that may help to guide pipe 18 through die 12.

Rod 16 may be associated to pipe 18 through the use of coupling 19. Coupling 19 may be a hollow cylinder that is operable to releasably attach rod 16 to pipe 18. FIG. 6 shows a detail of rod 16 contacting end 18*a* of pipe 18. Coupling 19 preferably has inside diameter 108 that is larger than outside diameter 100 of rod 16 so that portions of rod 16 may pass through coupling 19. Coupling 19 also preferably has inside diameter 108 that is larger than outside diameter 104 of pipe 18.

Pipe 18 may generally include, but not be limited to, welded steel pipe or ERW pipe. Welded pipe is often manufactured from coiled steel or plate steel through a pipe-making method such as an ERW (electric-resistance-welding) pipe-making method, a TIG (Tungsten Inert Gas) welding pipe-making method, or a laser welding pipe-making method, to thereby obtain pipe 18. In certain embodiments of the present invention, pipe 18 has outside diameter 104 of about one inch to about five and one-half inches prior to sizing. (See FIG. 6).

For the purposes of this application, pipe 18 may refer to any of the following: a pipe, a tube, pipes, tubes or combinations thereof. Different industries may differentiate between the terms pipe and tube. For example, some industries may refer to a pipe as a finished product and a tube as an unfinished product. The difference between the terms pipe and tube may also encompass the difference in dimensional control. For example, a tube may have dimensional control over the inside diameter, outside diameter and wall thickness. Rather, a pipe may only have dimensional control over the inside diameter and wall thickness. For the above reasons, the term pipe 18 should be read to include pipe, tube, pipes, tubes, related structures and/or combinations thereof.

In optional embodiments of the present invention, push bench section 40 may include support 24. Support 24 may brace pipe 18 and prevent pipe 18 from buckling while being pushed through die 12. Support 24 may also help guide pipe 18 through die 12. Support 24 preferably supports about a midpoint of pipe 18. In some embodiments, support 24 may be a movable support. As shown in FIG. 1, support 24 may move along rails 28*a* and 28*b*. FIG. 7 shows pipe sizing system 20 after hydraulic cylinder 14 has pushed pipe 18 through die 12. In FIG. 7, hydraulic cylinder 14 has pushed movable support 24 against die 12. A decision to use support 24 in an application may depend on such factors as the columnar strength of pipe 18 and the length over diameter (L/D) ratio of pipe 18. In some applications, an operator may decide to use more than one support 24. One skilled in the art, with the benefit of this application, will recognize appropriate situations to use support 24.

Figure 3:
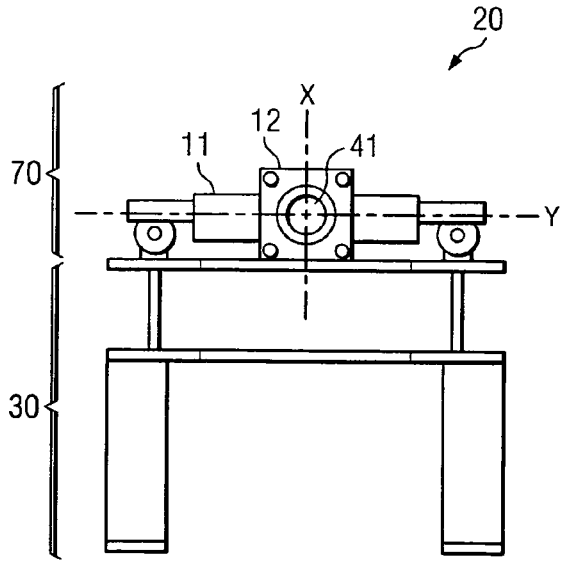
FIG. 3 is a schematic drawing taken along lines 3-3 of FIG. 1.
Figure 4:
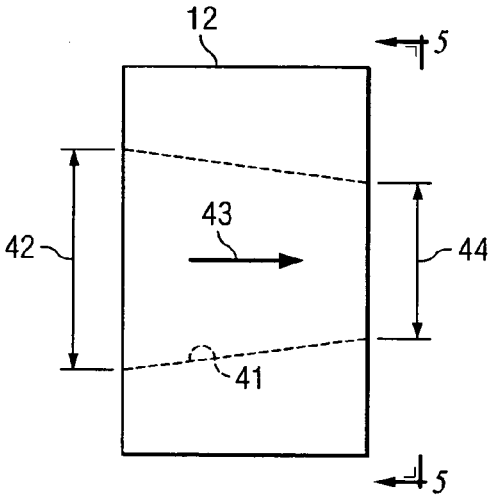
FIGS. 4 and 5 illustrate longitudinal, vertical and horizontal axes of a die according to the teachings of the present invention.
Figure 5:
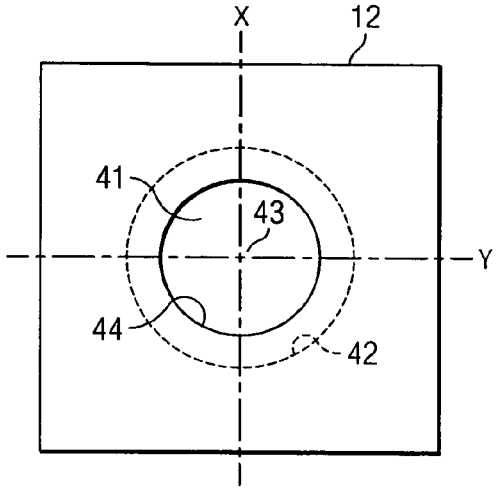

Pipe sizing system 20 includes die assembly 70. Die assembly 70 may include die housing 11 and die 12. Die 12 reduces outside diameter 104 of pipe 18 to form outside diameter 106. (See FIG. 6). FIG. 3 shows a schematic view taken along lines 3-3 of FIG. 1. FIG. 3 shows foundation 30 and die assembly 70 showing die housing 11 and die 12 with opening 41 operable to size pipe 18 as well as the vertical (x)

axis and horizontal (y) axis of die 12. Die housing 11 may serve to properly situate and secure die 12. FIGS. 4 and 5 show the longitudinal, vertical and horizontal axes of die 12. FIG. 4 shows die 12 with entering diameter 42 and exiting diameter 44 as well as longitudinal axis 43. FIG. 5 shows a schematic view taken along lines 5-5 of FIG. 4. FIG. 5 shows die 12 and longitudinal axis 43 with the vertical (x) axis and horizontal (y) axis. Various types of commercially available dies may be satisfactorily used in embodiments of the present invention. In certain exemplary embodiments, die 12 may reduce outside diameter 104 of pipe 18 from about 1% to about 20%.

In one embodiment of the present invention, once pipe 18 exits die 12, pipe 18 enters receiver section 80. In certain embodiments, receiver section 80 may include receiver 22, receiving guide 27, rails 29*a* and 29*b*, receiver table 62, and rail stop 32. Receiver 22 couples to pipe 18 and guides pipe 18. FIG. 6 shows pipe end 18*b* releasably securing in recess 109 of receiver 22. Once pipe 18 is secured in receiver 22, receiver 22 may act to guide and shape pipe 18. FIG. 1 shows an embodiment of receiver 22 that may produce a straight pipe. In FIG. 1, receiver 22 is positioned along longitudinal axis 43 and keeps the vertical axis and horizontal axis steady. In this embodiment, receiver 22 may be attached to receiver guide 27 (here shown on rails 29*a* and 29*b*). In optional embodiments, the distance that receiver 22 may travel may be limited by rail stop 32. FIG. 7 shows an embodiment where receiver 22 and receiver guide 27 has been halted by rail stop 32.

Figure 8:
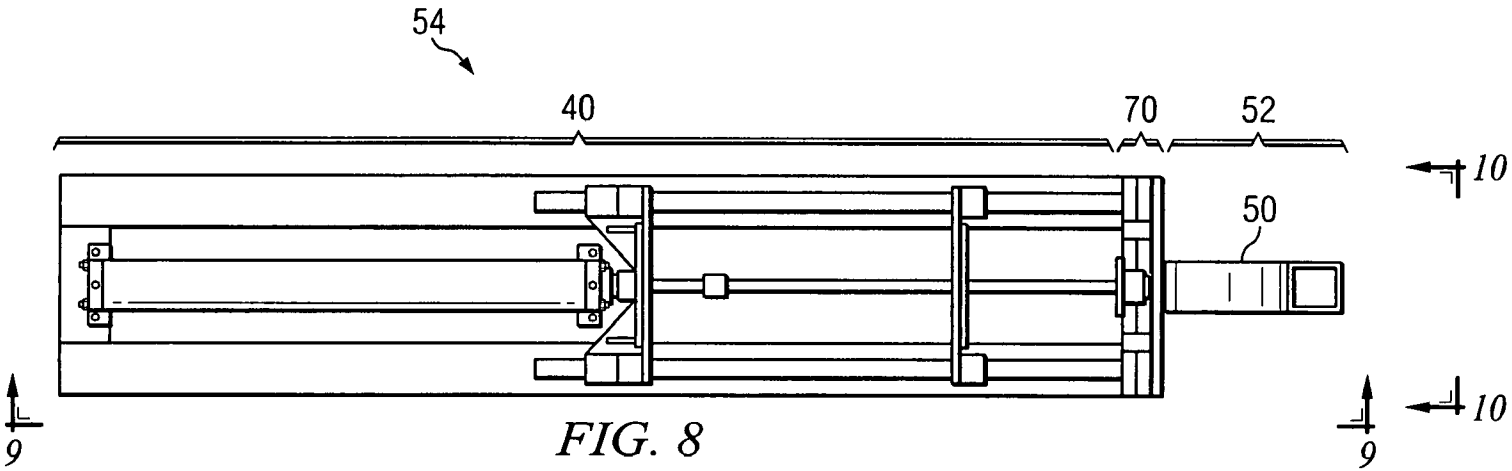
FIGS. 8 thru 10 are schematic drawings showing an example of a push bench system for sizing pipe in accordance with teachings of the present invention.
Figure 9:
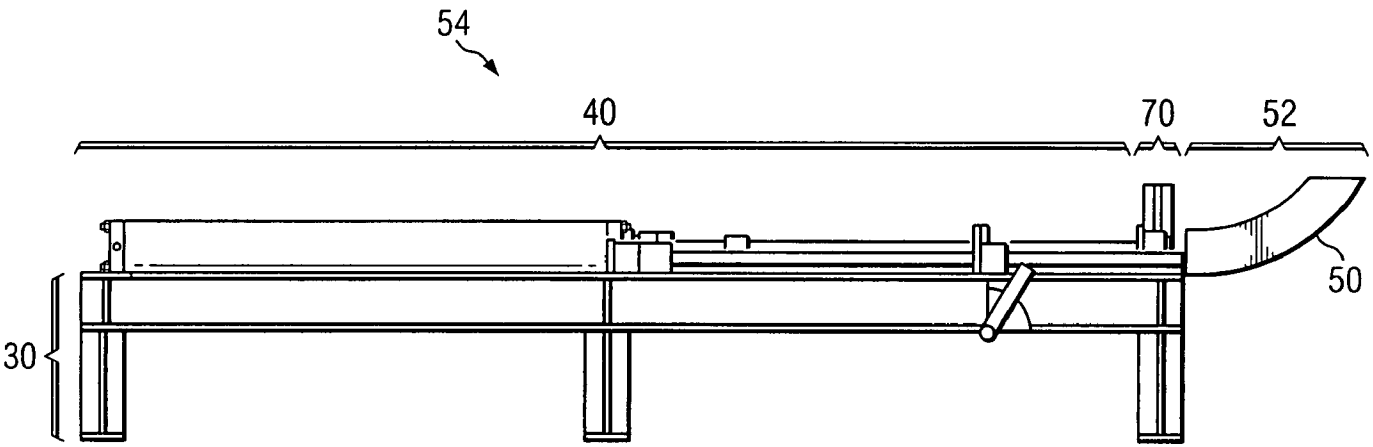
Figure 10:
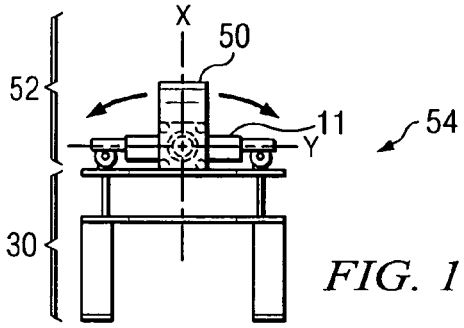

FIGS. 8 thru 10 show receiver section 52 in push bench system 54. In this embodiment, receiver section 52 may include receiver 50. Receiver 50 may be operable to move and rotate to form a pipe of a specific shape. As pipe 18 passes through die 12, the yield strength of pipe 18 is exceeded, therefore, pipe 18 may be bent with minimal energy as pipe 18 exits die 12. FIG. 8 shows receiver 50 being a chute able to bend pipe 18 into a curved shape. FIG. 9 shows an elevation view of receiver 50 taken along lines 9-9 of FIG. 8. FIG. 10 shows an end view of receiver 50 with the ability of receiver 50 to rotate along the x and y axis.

Figure 11:
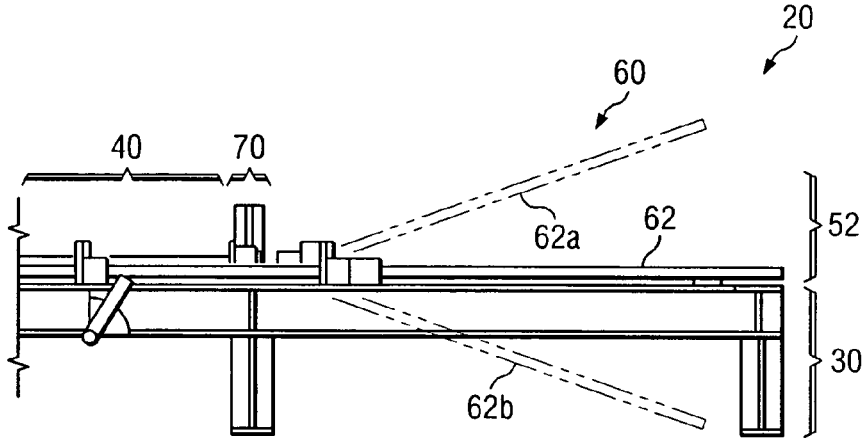
FIG. 11 is a schematic drawing with portions broken away showing an example of a movable receiver table of a pipe sizing system for sizing pipe in accordance with teachings of the present invention.

FIG. 11 shows an embodiment of push bench system 60 where receiver table 62 may be operable to move and rotate to form a pipe of a specific shape. In the represented embodiment, receiver table 62 may move receiver 22 up (position 62*a*) and down (position 62*b*) along the x axis and therefore bend pipe 18 to a desired shape. Although not represented, receiver table 62 may be able to move along the y axis as well.

Figure 12:
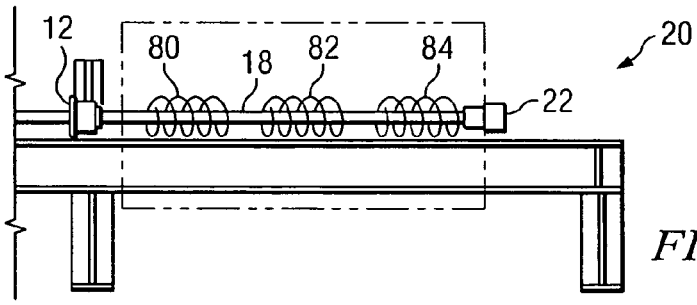
FIGS. 12 thru 15 are schematic drawings with portions broken away showing example post-die operations including pipe treatment and pipe inspection devices.
Figure 13:
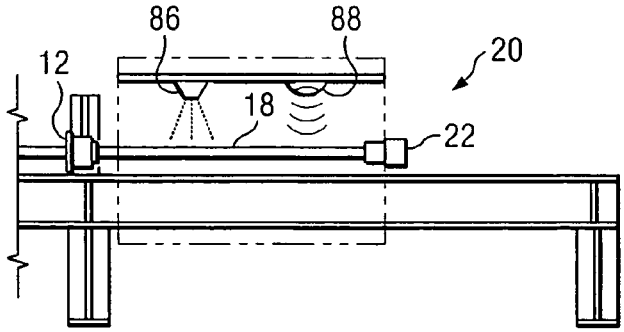
Figure 15:
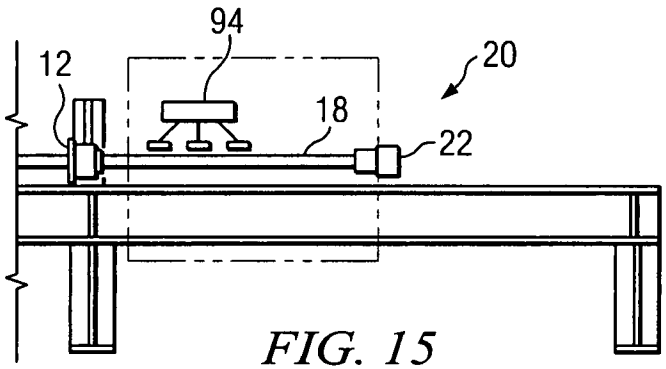
Figure 14:
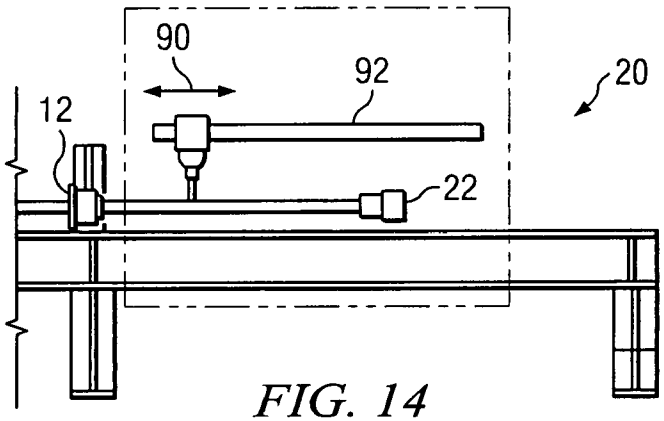

In certain embodiments of the present invention, pipe sizing system 20 may include a variety of post-die operations. FIGS. 12-15 show certain exemplary embodiments of post-die pipe operations including pipe treatment and inspection devices. FIGS. 12-14 show exemplary embodiments of pipe treatment devices and FIG. 15 shows an exemplary embodiment of a pipe inspection device.

FIG. 12 shows an exemplary thermal pipe treatment device of the present invention. As pipe 18 exits die 12, pipe 18 encounters quench and tempering systems. As hydraulic cylinder 14 may control the push speed through die 12, the push speed may be adjusted to allow proper quenching and tempering of pipe 18. In FIG. 12, austenizing coil 80 may austenize pipe 18 after existing die 12. Next, in the illustrated embodiment, water quenching coil 82 may be a water quenching ring to cool pipe 18. Then tempering coil 84 may temper pipe 18. Although the illustrated embodiment has the combination of austenizing coil 80, water quenching coil 82 and tempering coil 84, other embodiments may include just one coil, different combinations of coils or coils placed in different order relative to the die. Sizing and thermally treating pipe 18 in one step may increase manufacturing efficiency.

FIG. 13 shows a embodiment of the present invention that uses coating machine 86 as a pipe treatment device. In FIG. 13, as pipe 18 exits die 12, coating machine 86 applies a coating to pipe 18. In certain exemplary embodiments, coating machine 86 may be a phosphating machine. Also shown in FIG. 13, following coating machine 86 may be dryer 88 for pipe coatings that may require drying.

FIG. 14 illustrates an embodiment of the present invention where pipe 18 is machined after exiting die 12. In FIG. 14 drill 90 removes portions of pipe 18 after pipe 18 exits from die 12. Drill 90 may move along track 92. Track 92 may allow drill 90 to move in coordination with the push speed of hydraulic cylinder 14, thereby allowing drill 90 to move in synchronization with pipe 18. Although FIG. 14 shows only drill 90, other embodiments of this invention may include other machining tools such as saws.

FIG. 15 shows an embodiment of the present invention where pipe 18 is inspected by inspection device 94 as pipe 18 exits die 12. Inspection device 94 may be an ultrasonic pipe inspection device or another pipe inspection device known in the art. In the illustrated embodiment, inspection device 94 is an ultrasonic unit that uses shoes to touch pipe 18 and inspects a linear portion of pipe 18. In another embodiment, inspection device 94 is an ultrasonic unit that surrounds pipe 18 and inspects 360° of pipe 18. Although not illustrated, pipe sizing system 20 may have more than one inspection device 94 located after die 12. Having an inspection device 94 immediately after pipe 18 exits die 12 may allow immediate feedback as to the quality of pipe 18 being produced and may eliminate the need for a separate pipe inspection operation.

Figure 16:
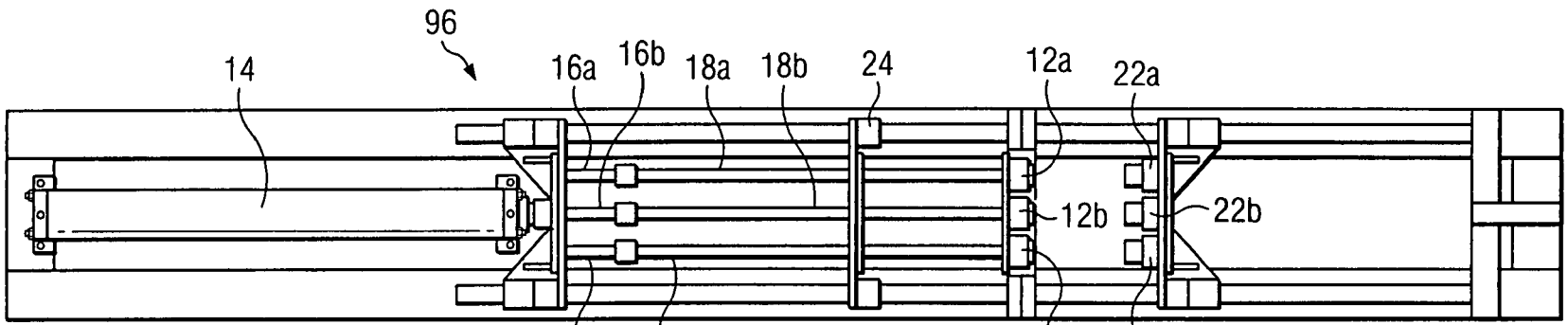
FIG. 16 is a schematic drawing showing a plan view of another embodiment of a push bench system in accordance with teachings of the present invention.

FIG. 16 shows an exemplary embodiment of the present invention where at least two pipes are sized through at least two dies. In FIG. 16, hydraulic cylinder 14 and three rods 16*a-c* push three pipes 18*a-c* through three individual dies 12*a-c*. As pipes 18*a-c* exit dies 12*a-c*, receivers 22*a-c* may engage and shape pipes 18*a-c*. Sizing three pipes at one time may provide for greater manufacturing throughput and efficiency.

Figure 17:
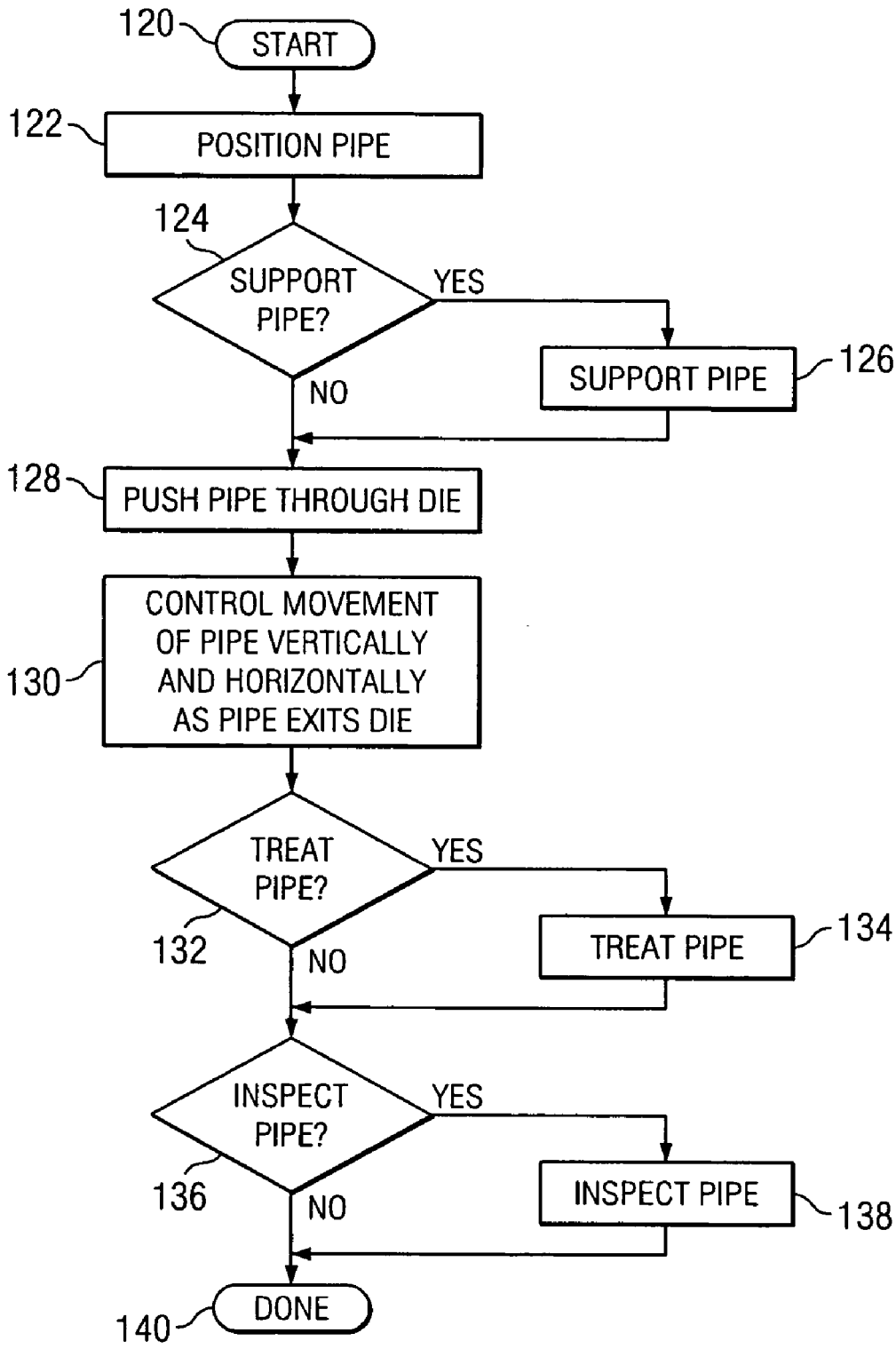
FIG. 17 is a flow diagram showing a method of sizing pipe according to teachings of the present invention.

FIG. 17 illustrates an example method of the present invention for sizing pipe 18. The method begins at step 120. Then the method proceeds to step 122 where pipe 18 is positioned along longitudinal axis 43 of die 12. To guide pipe 18 along longitudinal axis 43, end 18*a* of pipe 18 may come into contact with rod 16. (See FIG. 6). In certain exemplary embodiments of the present invention, coupling 19 may serve to releasably secure rod 16 to pipe 18.

Once pipe 18 has been positioned, the method proceeds to step 124 where an operator must decide if pipe 18 needs support 24. Factors such as the length and diameter of pipe 18 may determine if the operator decides to use support 24. If the operator decides not to use support 24, then the method continues to step 128. If the operator decides to use support 24, then the method proceeds to step 126 where support 24 is added to brace pipe 18. In certain exemplary embodiments, support 24 braces pipe 18 at about the midpoint of pipe 18. After pipe 18 has been braced by support 24, the method proceeds to step 128.

At step 128, at least one hydraulic cylinder 14 pushes pipe 18 through die 12. During this process outside diameter 104 of pipe 18 is reduced to outside diameter 106. (See FIG. 6). In some embodiments, outside diameter 104 of pipe 18 is reduced from about 1% to about 20%.

Embodiments of the present invention include pushing pipe 18 through die 12 without the use of a mandrel. By not using a mandrel, pipe 18 may lose less fracture toughness than if a mandrel was used.

Once a portion of pipe 18 exits die 12, the method moves to step 130, where the movement of pipe 18 is controlled vertically and horizontally relative to longitudinal axis 43.

At step 130, an operator may decide to produce a straight pipe by using receiver 22 in pipe sizing system 20 (See FIG. 1). In this embodiment, receiver 22 is a fixed receiver that holds pipe 18 generally concentrically aligned with longitudinal axis 43 as pipe 18 exits die 12. In another embodiment, the operator may decide to form pipe 18 of a specific shape. In this embodiment, the operator may use receiver 50 in push bench system 54 to vary the vertical and lateral movement of pipe 18 as pipe 18 exits die 12. (See FIGS. 8-10). In certain embodiments, push bench system 60 may be used to bend and rotate exiting pipe 18. (See FIG. 11).

Once pipe 18 has passed through die 12, the method proceeds to step 132. At step 132, an operator may optionally decide whether to perform a post-die operation on pipe 18. One post-die operation an operator may decide to perform is to treat pipe 18. If the operator decides not to treat pipe 18, the method proceeds to step 136. If the operator decides to treat pipe 18, the method proceeds to step 134, where pipe 18 may be treated by at least one pipe treatment device. Pipe treatment devices may include austenizing coil 80, water quenching coil 82, tempering coil 84, coating and/or phosphating machine 86, dryer 88, drill 90 and combinations thereof. Once pipe 18 has been treated, the method proceeds to step 136.

At step 136 an operator may optionally decide to inspect pipe 18. If the operator decides not to inspect pipe 18, the method proceeds to step 140 where pipe 18 is ready for use. If the operator decides to inspect pipe 18, the method proceeds to step 138 where inspection device 94 inspects pipe 18. In certain embodiments, inspection device 94 may be an ultrasonic inspection device. Once pipe 18 has been inspected the method proceeds to step 140 where pipe 18 is ready for use.

The previous methods and systems may be used to produce pipe for use in portions of automotive, construction and agricultural equipment and in industrial applications such as hydraulic cylinders, machine parts and printing rollers. Such examples of automotive industry pipe include, but are not limited to, stabilizer tubes.

The previous methods and systems may also be used to produce line pipe, casing and tubing as well as other applications. Line pipe is typically used in the surface transmission of oil, natural gas and other fluids. Casing or well casing, is typically used as a structural retainer for oil and gas wells. Casing is used to prevent contamination of both the surrounding water table and the well itself. Casing preferably lasts the life of a well and is not usually removed when a well is plugged and abandoned. Tubing may refer to OCTG applications and petrochemical applications. When referring to OCTG, tubing is a separate pipe used within the casing to conduct the oil or gas to the surface. Depending on conditions and well life, tubing may have to be replaced during the operational life of a well. When referring to petrochemical applications, tubing may refer to tubes used to transport chemical substances within a petrochemical plant. All the above applications list potential uses for pipe 18 sized according to methods and systems of the present invention. This list does not limit the other potential applications of pipe 18 formed in accordance with teachings of the present invention.

Embodiments of the present invention also include methods for forming a push bench operable to size pipe 18. The methods include installing die 12 having longitudinal axis 43 and opening 41 able to size pipe 18; installing hydraulic cylinder 14 having at least one rod 16 attached thereto along longitudinal axis 43; and installing a receiver (22 or 50) along the longitudinal axis 43.

Optionally the method may include installing at least one support 24 along longitudinal axis 43 to brace pipe 18 before entering die 12 and/or installing at least one coupling 19 to releasably secure pipe 18 to rod 16. Optionally, the method of forming a push bench may include installing at least one pipe treatment device and/or at least one pipe inspection device.

Although the present invention and its advantages have been described in detail, it should be understood that various changes, substitutions and alterations can be made herein without departing from the spirit and scope of the invention as defined by the following claims.

What is claimed is:

1. A method of reducing an outside diameter of a pipe comprising:

positioning the pipe to pass through a die having a longitudinal axis;

pushing the pipe through the die using at least one hydraulic cylinder; and controlling movement of the pipe vertically (x direction) and laterally (y direction) relative to the longitudinal axis as the pipe exits from the die.

2. The method of claim 1 wherein controlling movement of the pipe comprises holding the pipe generally concentrically aligned with the longitudinal axis as the pipe exits the die.

3. The method of claim 1 further comprising supporting the pipe as the pipe passes through the die.

4. The method of claim 3 further comprising supporting the pipe by initially bracing the pipe at about a mid-section of the pipe.

5. The method of claim 1 further comprising pushing the pipe through the die during a cold finishing process.

6. The method of claim 1 further comprising pushing the pipe through the die with a controlled push speed.

7. The method of claim 1 wherein pushing the pipe through the die comprises reducing an outside diameter of the pipe from about 1% to about 20%.

8. The method of claim 1 further comprising simultaneously pushing a second pipe and a third pipe through a second die and a third die using the at least one hydraulic cylinder.

9. The method of claim 1 wherein pushing the pipe through the die comprises pushing the pipe through the die without the use of a mandrel.

10. A method of reducing an outside diameter of a pipe comprising:

positioning the pipe to pass through a die having a longitudinal axis;

pushing the pipe through the die using at least one hydraulic cylinder;

controlling movement of the pipe relative to the longitudinal axis as the pipe exits from the die; and varying vertical and lateral movement of the pipe as the pipe exits the die.

11. A method of reducing an outside diameter of a pipe comprising:

positioning the pipe to pass through a die having a longitudinal axis;

pushing the pipe through the die using at least one hydraulic cylinder;

controlling movement of the pipe vertically (x direction) and laterally (y direction) relative to the longitudinal axis as the pipe exits from the die; and performing at least one post-die operation as the pipe exits from the die.

12. The method of claim 11 wherein performing at least one post-die operation comprises treating the pipe.

13. The method of claim 12 wherein treating the pipe is selected from the group consisting of austenizing the pipe, thermally treating the pipe, quenching the pipe, tempering the pipe, coating the pipe, phosphating the pipe, drilling the pipe and combinations thereof.

14. The method of claim 11 wherein performing at least one post-die operation comprises inspecting the pipe.

* * * * *